US009169566B2

(12) United States Patent
Morhard et al.

(10) Patent No.: US 9,169,566 B2
(45) Date of Patent: Oct. 27, 2015

(54) METHOD FOR SPATIALLY RESOLVED ENLARGEMENT OF NANOPARTICLES ON A SUBSTRATE SURFACE

(75) Inventors: Christoph Morhard, Stuttgart (DE); Claudia Pacholski, Stuttgart (DE); Joachim P. Spatz, Stuttgart (DE)

(73) Assignee: Max-Planck-Gesellschaft zur Foerderung der Wissenschaften e.V., Munich (DE)

( * ) Notice: Subject to any disclaimer, the term of this patent is extended or adjusted under 35 U.S.C. 154(b) by 582 days.

(21) Appl. No.: 13/510,107

(22) PCT Filed: Nov. 15, 2010

(86) PCT No.: PCT/EP2010/006938

§ 371 (c)(1), (2), (4) Date: Jun. 7, 2012

(87) PCT Pub. No.: WO2011/057816

PCT Pub. Date: May 19, 2011

(65) Prior Publication Data

US 2012/0244322 A1 Sep. 27, 2012

(30) Foreign Application Priority Data

Nov. 16, 2009 (DE) ..... 10 2009 053 406

(51) Int. Cl.
*B44C 1/22* (2006.01)
*B05D 3/06* (2006.01)
(Continued)

(52) U.S. Cl.
CPC ..... *C23C 18/1603* (2013.01); *C23C 18/1605* (2013.01); *C23C 18/1612* (2013.01);
(Continued)

(58) Field of Classification Search
CPC ..... C23C 18/1603; C23C 18/1605; C23C 18/1612; C23C 18/1667; C23C 18/1841; C23C 18/1889; C23C 18/44; H01L 2224/13562; H01L 31/022466; H01L 31/1884; H01L 51/444; H01L 51/5203
USPC ..... 216/13, 41, 83; 427/558; 977/773
See application file for complete search history.

(56) References Cited

U.S. PATENT DOCUMENTS

2007/0207335 A1* 9/2007 Karandikar et al. ..... 428/560
2010/0103524 A1 4/2010 Spatz et al.
2010/0112234 A1* 5/2010 Spatz et al. ..... 427/535

FOREIGN PATENT DOCUMENTS

CA 2308302 A1 5/1999
DE 102007014538 A1 10/2008
(Continued)

OTHER PUBLICATIONS

Dykman, et al., "Gold nanoparticles: preparation, functionalisation and applications in biochemistry and immunochemistry", Russian Chemical Reviews, vol. 76, No. 2, pp. 181-194 (2007).
(Continued)

*Primary Examiner* — Shamim Ahmed
(74) *Attorney, Agent, or Firm* — Caesar Rivise, PC

(57) ABSTRACT

The invention relates to a method for spatially resolving the enlargement and fine adjustment of precious metal nanoparticles according to size on a substrate surface and to the nanoparticle arrangements and nanostructured substrate surfaces thereby produced and to the use thereof. The invention particularly relates to a method for spatially resolving the enlargement of precious metal nanoparticles present on a substrate, comprising the following steps: a) providing a substrate coated by precious metal nanoparticles, b) optionally functionalizing the substrate by means of an agent which supports the adhesion of the precious metal nanoparticles to the substrate, c) contacting the substrate with a precious metal salt solution, d) UV irradiating the substrate in contact with the precious metal salt solution, thus creating a reduction of the precious metal salt and a currentless deposition of elementary precious metal on the precious metal nanoparticles and corresponding growth of the precious metal nanoparticles in the irradiated regions of the substrate, and e) optionally using a mask in order to create localized growth of the precious metal nanoparticles in predetermined regions of the substrate.

16 Claims, 9 Drawing Sheets

(51) Int. Cl.

| | |
|---|---|
| ***B82Y 30/00*** | (2011.01) |
| ***C23C 18/16*** | (2006.01) |
| ***C23C 18/18*** | (2006.01) |
| *C23C 18/44* | (2006.01) |

(52) U.S. Cl.
CPC ..... *C23C18/1667* (2013.01); *C23C 18/1841* (2013.01); *C23C 18/1889* (2013.01); *C23C 18/44* (2013.01); *Y10T 428/24612* (2015.01); *Y10T 428/24909* (2015.01)

(56) References Cited

FOREIGN PATENT DOCUMENTS

| | | | |
|---|---|---|---|
| DE | 102007017032 | A1 | 10/2008 |
| EP | 1027157 | B1 | 8/2003 |
| EP | 1626106 | A2 | 2/2006 |
| EP | 1760527 | A1 | 3/2007 |
| WO | 2008125172 | A2 | 10/2008 |

OTHER PUBLICATIONS

Fan, et al., "Beyond superquenching: Hyper-efficient energy transfer from conjugated polymers to gold nanoparticles", PNAS, vol. 100, No. 11, pp. 6297-6301 (2003).
Gorzolnik, et al., "Nano-structured micropatterns by combination of block copolymer self-assembly and UV photolithography", Nanotechnology, vol. 17, pp. 5027-5032 (2006).
Haertling, et al., "Controlled photochemical particle growth in two-dimensional ordered metal nanoparticle arrays", Nanotechnology, vol. 21, pp. 1-6 (2010).
Henley, et al., "Laser direct write of silver nanoparticles from solution onto glass substrates for surface-enhanced Raman spectroscopy", Applied Physics Letters, vol. 91, pp. 023107-1-023107-3 (2007).
Hrapovic, et al., "New Strategy for Preparing Thin Gold Films on Modified Glass Surfaces by Electroless Deposition", Langmuir, vol. 19, pp. 3958-3965 (2003).
Kimling, et al., "Turkevich Method for Gold Nanoparticle Synthesis Revisited", J. Phys. Chem. B., vol. 110, pp. 15700-15707 (2006).
Lohmueller, et al., "Biomimetic Interfaces for High-Performance Optics in the Deep-UV Light Range", Nano Letters, vol. 8, No. 5, pp. 1429-1433 (2008).
Mallick, et al., "Seed-mediated successive growth of gold particles accomplished by UV irradiation: a photochemcial approach for size-controlled synthesis", Journal of Photochemistry and Photobiology V: Chemistry, vol. 140, pp. 75-80 (2001).
Sato, et al., "Single electron transistor using a molecularly linked gold colloidal particle chain", J. App. Phys., vol. 82, pp. 696-701 (1997).
Yang, et al., "Continuous synthesis of gold nanoparticles and nanoplates with controlled size and shape under UV irradiation", Colloids and Surfaces A: Physicochem. Eng. Aspects, vol. 296, pp. 37-44 (2007).
International Search Report for PCT/EP2010/006938 dated Jun. 10, 2011.

* cited by examiner

METHOD FOR SPATIALLY RESOLVED ENLARGEMENT OF NANOPARTICLES ON A SUBSTRATE SURFACE

BACKGROUND OF INVENTION

The present invention concerns a method for spatially resolving the enlargement and fine adjustment of precious metal nanoparticles according to size on a substrate surface and the nanoparticle arrangements and nanostructured substrate surfaces so produced, and the use thereof.

In recent years, nanostructures and especially ordered structures of precious metal nanoparticles on substrate surfaces have found great interest for a number of applications in different fields. For example, gold nanoparticles can be employed in biochemical sensors (Dyckman and Bogatyrev (2007), Russian Chemical Reviews 76(2), 181-194) and as etching masks to make biomimetic surfaces and interfaces (Lohmüller et al. (2008), NANO LETTERS 8 (5): 1429-1433).

For many of these applications it would be very desirable to adjust the size of these nanoparticles locally and in the nanometer scale on macroscopic substrates with the greatest possible precision. For example, more linker molecules and thus also more desired target molecules could be bound to larger nanoparticles and this capability could be used to produce concentration gradients of a given antigen on a substrate. Thus, e.g., concentration-sensitive biochips could be produced in easy fashion. A fine adjustment of the particle size with high spatial resolution would also be very advantageous for the aforementioned use as etching masks. Such a fine adjustment would make possible, for example, the production of complex nano-optical elements such as Fresnel lenses and zone plates. Ordered areas of precious metal nanoparticles with given diameters could also be used to advantage in new transistors (Sato et al. (1997), American Institute of Physics 82(2), 696-702) or for fluorescence quenching (Fan et al. (2003), PNAS, 100 (1), 6297-6301).

The size of precious metal nanoparticles, especially gold nanoparticles, can basically be adjusted before the deposition on the substrate surface, e.g., by using metal colloids (Kimling et al. (2006), J. Phys. Chem. B., 110, 15700-15707), or after the deposition, e.g., by currentless deposition using a reducing agent (Hrapovic et al. (2007), Langmuir 19:3958-3965). However, in these methods described in the prior art, only a limited size adjustment is possible and most importantly no spatially resolved adjustment of the nanoparticle size.

In German patent application DE 10 2007 017 032 and the corresponding international application PCT/EP2008/0071981 methods are described for the creating of interparticle distance and particle size gradients in gold nanoparticle arrangements that were produced by means of micellar block copolymer nanolithography (BCML). In these methods, particle size gradients are created either by currentless deposition from a solution containing elemental gold, as above, but under variation of the rate at which a substrate surface covered with nanoparticles is pulled out from this solution, or by irradiation with a lateral intensity-modulated light field.

But these methods are not fully satisfactory or suitable for all applications, since it is hard to create several regions with greatly different mean diameters of the nanoparticle and high spatial resolution alongside each other.

A main problem of the present invention was thus to provide improved methods for spatially resolving the enlargement and fine adjustment of precious metal nanoparticles on a substrate surface according to size, by which even very sharp particle size gradients or nanoparticle arrangements containing several regions with greatly differing mean diameters of the nanoparticles and high spatial resolution alongside each other can be produced in an easy and efficient manner. A related problem was to provide the corresponding nanoparticle arrangements and nanostructured substrate surfaces. Yet another problem was to provide the nanoparticle arrangements and nanostructured substrate surfaces produced according to the invention for various applications that thus far were not considered on account of the inadequate or impossible fine adjustment of precious metal nanoparticle arrangements on a substrate surface according to size.

Now, according to the invention, it has been found that the aforementioned main problem can be solved by the method according to the invention, wherein a substrate coated with (preferably fixed) precious metal nanoparticles is contacted with a precious metal salt solution and a localized and controlled enlargement of the nanoparticles in certain given regions is brought about by UV irradiation of these regions. The above-mentioned additional problems are solved by providing the nanoparticle arrangements and nanostructured substrate surfaces and by the use according to the present invention.

SPECIFICATION OF THE INVENTION

The present invention concerns a method for spatially resolving the enlargement of precious metal nanoparticles that are present on a substrate, comprising the following steps:

a) providing a substrate coated with precious metal nanoparticles, b) optionally functionalizing the substrate with an agent that supports the adhesion of the precious metal nanoparticles to the substrate, c) contacting the substrate with a precious metal salt solution, d) UV irradiating of the substrate in contact with the precious metal salt solution, thus creating a reduction of the precious metal salt and a currentless deposition of elemental precious metal on the precious metal nanoparticles and corresponding growth of the precious metal nanoparticles in the irradiated regions of the substrate, e) optionally using a mask to bring about a localized growth of the precious metal nanoparticles in predetermined regions of the substrate.

The providing of a substrate coated with precious metal nanoparticles in the above step a) can essentially be done with all methods known in the prior art. For example, a precious metal colloid layer can be deposited on the substrate surface (see Hrapovic et al., above). Another preferred method of the invention, if ordered nanoparticle structures are to be prepared, consists in creating a precious metal nanoparticle arrangement on a substrate by micellar nanolithography, especially micellar block copolymer nanolithography (BCML) (see, e.g., EP 1 027 157). In micellar block copolymer nanolithography, a micellar solution of a block copolymer is deposited onto a substrate, e.g., by dip coating, and under suitable conditions it forms on the surface an ordered film structure of chemically different polymer domains, depending on the type, molecular weight and concentration of the block copolymer, among other things. The micelles in the solution can be laden with inorganic salts, which can be reduced to inorganic nanoparticles after the deposition with the polymer film. To remove the polymer, as a rule one carries out a plasma treatment, e.g., with hydrogen plasma.

The substrate material used according to the invention is basically not limited in any way and can comprise any material, as long as it is resistant under the conditions of the method of the invention and does not impair or disrupt the reactions taking place. For example, the substrate can be chosen from glass, $SiO_2$, silicon, metals (with or without passivated surfaces), semiconductor materials, such as GaAs, GaP, GaInP, AlGaAs, (optionally doped) metal oxides, such as ZnO, $TiO_2$, carbon (graphite, diamond), polymers, etc., and composite materials of these. For some applications, transparent substrates like glass or ITO on glass are preferred.

The precious metal of the nanoparticles is also not particularly limited and can comprise any precious metal or mixtures or composites of several precious metals (hybrid particles) or mixtures of a precious metal with another metal that is known in the prior art for such nanoparticles. Preferably, the precious metal is selected from the group of Au, Pt, Pd, Ag or mixtures/composites of these metals and especially preferably it is gold.

The original nanoparticles typically have diameters in the range of 1 nm to 100 nm, preferably 4 nm to 30 nm. The interparticle distances can be varied at will over a broad range, for example, in the range of 20 to 1000 nm, typically in the range of 30 to 250 nm.

To carry out the method of the invention, it is important to ensure a good adhesion of the precious metal nanoparticles on the substrate surface. To improve the adhesion, therefore, the substrate can be treated if necessary after the deposition of the nanoparticles, but before their enlargement, with an agent that supports the adhesion of the nanoparticles. Especially when using a substrate surface of glass or silicon dioxide coated with gold nanoparticles, but also Si, ZnO, $TiO_2$, GaAs surfaces and similar surfaces, it is preferred to treat the substrate with an agent that supports the adhesion of the gold nanoparticles. This will preferably be a silane, especially one selected from the group consisting of 3-aminopropyltriethoxysilane (APS), 3-mercaptopropyltriethoxysilane (MPS), N-[3-(trimethoxysilyl)propyl)ethylene diamine, 3-[2-(2-aminoethylamino)-ethylamino]propyltrimethoxysilane, 3 -aminopropyldimethyl-methoxysilane, 3-aminopropyl)tris (trimethylsiloxy)silane and 3-mercaptopropyltrimethoxysilane.

The precious metal salt solution that is brought into contact with the substrate surface in step c) can essentially be any metal salt solution that is suitable for the UV-induced currentless deposition of the desired precious metal on the precious metal nanoparticles. In one preferred embodiment, this is an aqueous metal salt solution to which an organic compound has been added, which during or after UV irradiation forms organic radicals that serve as reducing agents for the precious metal ions. Preferably, this organic compound is selected from the group of aldehydes, ketones or alcohols, especially C1-C10 alcohols. Especially preferably, the C1 -C10 alcohol is chosen from methanol, ethanol, propanol, butanol and ethylene glycol. The organic compound fraction can easily be adjusted by the skilled person with routine trial and error in order to vary the rate and the extent of the reduction. Typically, the volume ratio of aqueous metal salt solution and organic compound lies in the range of 100:1 to 1:2, preferably 10:1 to 1:1, such as 3:1 or 1:1.

In one specific embodiment, the precious metal salt solution is a gold salt solution, preferably a $HAuCl_4$ solution.

The length of the UV irradiation can vary depending on the extent of the desired nanoparticle enlargement and the particular substrate parameters and a suitable treatment length can easily be adjusted by the skilled person with routine trial and error. Typically, the UV irradiation is carried out for a time of 1 to 60 minutes, preferably 1 to 15 minutes, and at a wavelength in the range of 200 to 600 nm, preferably 200 to 400 nm.

Preferably, the method of the invention is carried out so that the conditions of the UV irradiation are varied for at least two different regions of the substrate, so that at least two different regions with different mean diameters of the precious metal nanoparticles are created for at least two different regions of the substrate. This variation of the conditions of the UV irradiation is or includes, for example, a variation of the time or irradiation.

In one preferred embodiment, the method of the invention is carried out by using a mask (step e)) in order to bring about a localized growth of the precious metal nanoparticles in predetermined regions of the substrate.

In one more particular embodiment, the mask has structures that, under suitable conditions of irradiation, enable a diffraction of the incoming UV light, and the method is carried out under such conditions, especially a suitable wavelength, that a diffraction pattern or brightness pattern is formed on the substrate surface and the growth of the precious metal nanoparticles occurs selectively in the more heavily irradiated regions of the diffraction pattern or brightness pattern.

These structures can comprise, for example, one or more pinhole diaphragms with a small pinhole diameter, preferably <100 μm, more preferably <10 μm, other diffraction lattices, diffraction edges, periodic patterns or gradients, such as gradual gray filters. The pinhole diaphragms for example can have a circular, elliptical, rectangular or triangular form.

According to the invention, it is especially preferred that the pinhole diaphragm(s) have a circular diameter, so that when irradiated a diffraction pattern of concentric rings is formed on the substrate surface and the different regions created with different mean diameters of the precious metal nanoparticles likewise form a pattern of concentric rings.

The present invention also concerns a method for making a nanostructured substrate surface, comprising steps a)-e) supra, and also:

f) subjecting the substrate with the precious metal nanoparticle arrangement created in steps a)-e) to at least one etching step, in which the precious metal nanoparticles act as an etching mask, whereby selective etching in predetermined regions of the substrate creates a desired relief configuration of the substrate surface while retaining the pattern of the precious metal nanoparticle arrangement. Preferably, a dry etching method adapted to the substrate will be used for this. In the case of $SiO_2$, for example, a "reactive ion" etching step using a fluorine-containing etching gas. Suitable methods are described, e.g., in Lohmüller et al. (2008), NANO LETTERS, Vol. 8, No. 5, 1429-1433. However, other etching methods known in the prior art and suitable for the particular substrate can also be used.

In particular, this method comprises the steps a)-e) supra and also:

f) subjecting the substrate with the precious metal nanoparticle arrangement created in steps a)-e), in which different regions with different mean diameters of the precious metal nanoparticles form a pattern of concentric rings, to at least one etching step, in which the precious metal nanoparticles act as an etching mask, whereby selective etching in predetermined regions of the substrate creates a relief configuration of the substrate surface that corresponds to a Fresnel lens, while retaining the pattern of concentric circles.

Further objects of the invention are nanostructured substrate surfaces and arrangements of precious metal nanoparticles on a substrate that can be obtained with the above methods.

These arrangements typically comprise two or more different regions of precious metal nanoparticles with a mean diameter in the range of 5-200 nm, preferably 5-20 nm, and a mean spacing in the range of less than 1 μm, preferably 30 to 250 nm, wherein precious metal nanoparticles are present in the different regions with a given different mean diameter.

In one specific and preferred embodiment, the arrangements are characterized in that the different regions with different mean diameters of the precious metal nanoparticles form one or more geometrical patterns, which correspond to the diffraction patterns or brightness patterns produced by diffraction of light on circular, elliptical, rectangular, triangular pinhole diaphragms, edges, or other periodically arranged patterns and gradients, such as gradual gray filters.

Especially preferably, the different regions form a pattern of concentric rings.

The nanostructured substrate surfaces and arrangements of precious metal nanoparticles on a substrate that can be obtained with the above methods of the invention form advantageous application prospects in the most diverse technical fields, due to the possibility of fine adjustment of the particle size with high spatial resolution and precise representation of geometrical patterns with several sharply separated regions of different particle size.

Accordingly, another aspect of the present invention also concerns the use of these nanostructured substrate surfaces and arrangements in the fields of biochips, imaging, electronics, data processing, spectroscopy, sensors, optics, lithography.

One such use is, for example, in the making of optical and electronic devices. In a more specific embodiment, the devices are selected from the group comprising a mask, especially a lithography or photography mask, a biochip, a sensor, an optical device, especially a Fresnel lens, an optical lattice, a microlens array or a transistor.

Another object of the invention also concerns the devices themselves that comprise such nanostructured substrate surfaces or arrangements. In one particular embodiment, these devices involve a mask, especially a lithography or photography mask, a biochip, a sensor, an optical device, especially a Fresnel lens, an optical lattice, a microlens array or a transistor.

The following examples will serve to further explain the present invention, but without limiting it to them.

EXAMPLE 1

Localized Growth in Size of Gold Nanoparticles Without Diffraction Pattern

Figure 1:
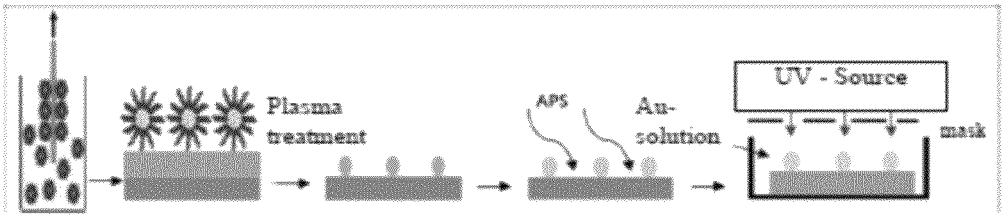
FIG. 1 shows a basic diagram on the method of the invention carried out with a gold nanoparticle arrangement prepared by micellar nanolithography (BCML).
Figure 2:
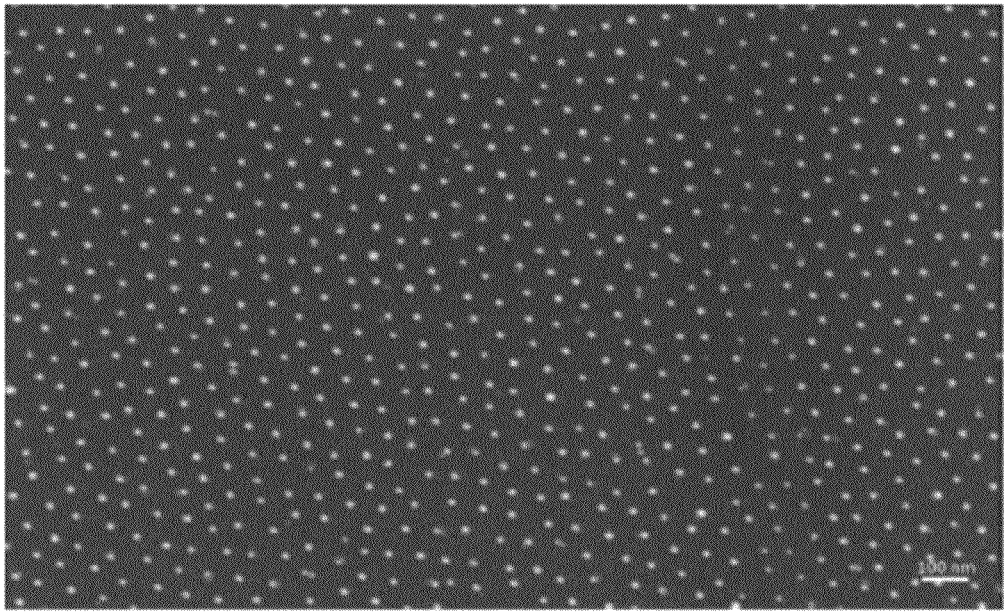
FIG. 2 shows a gold nanoparticle arrangement directly after BCML with no further enlargement treatment of the particles (diameter of nanoparticles: around 9 nm).
Figure 3:
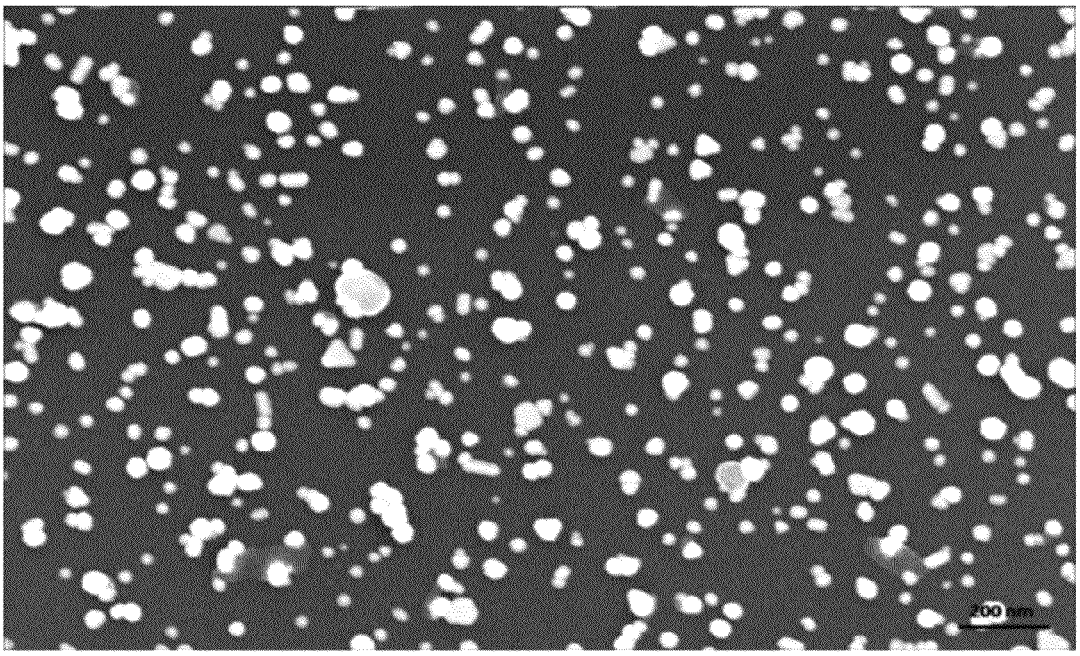
FIG. 3 shows the outcome of a currentless deposition of gold without prior fixation (silanization) of the nanoparticles: inhomogeneous particle growth and disrupted ordering
Figure 4:
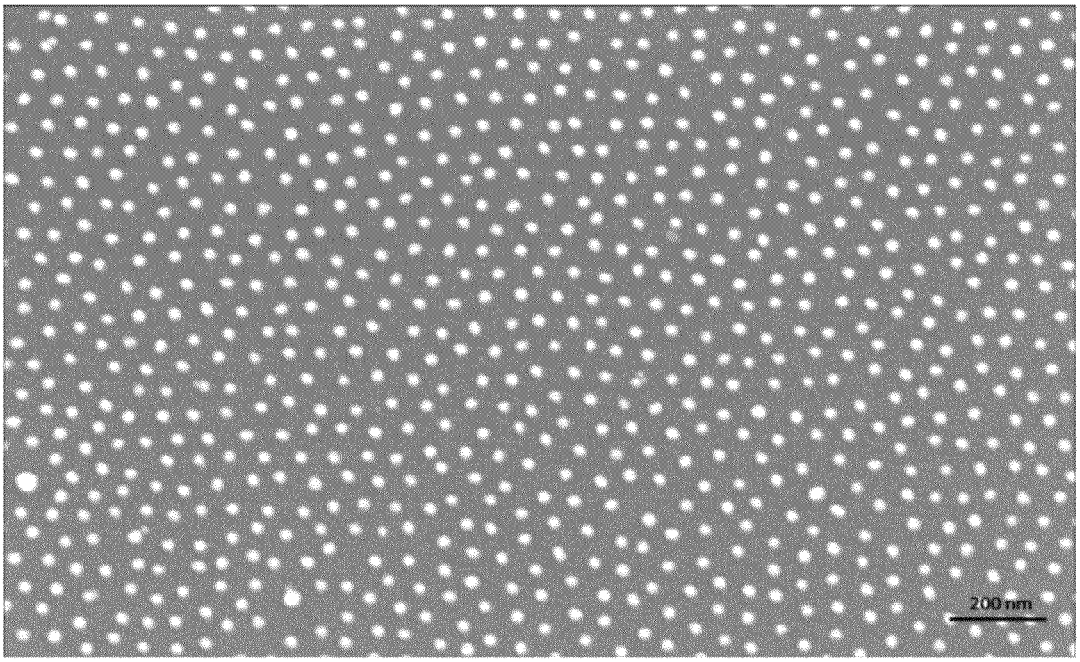
FIG. 4 shows gold nanoparticles after silanization and 2.5 min of UV irradiation (diameter of nanoparticles: around 13 nm).
Figure 5:
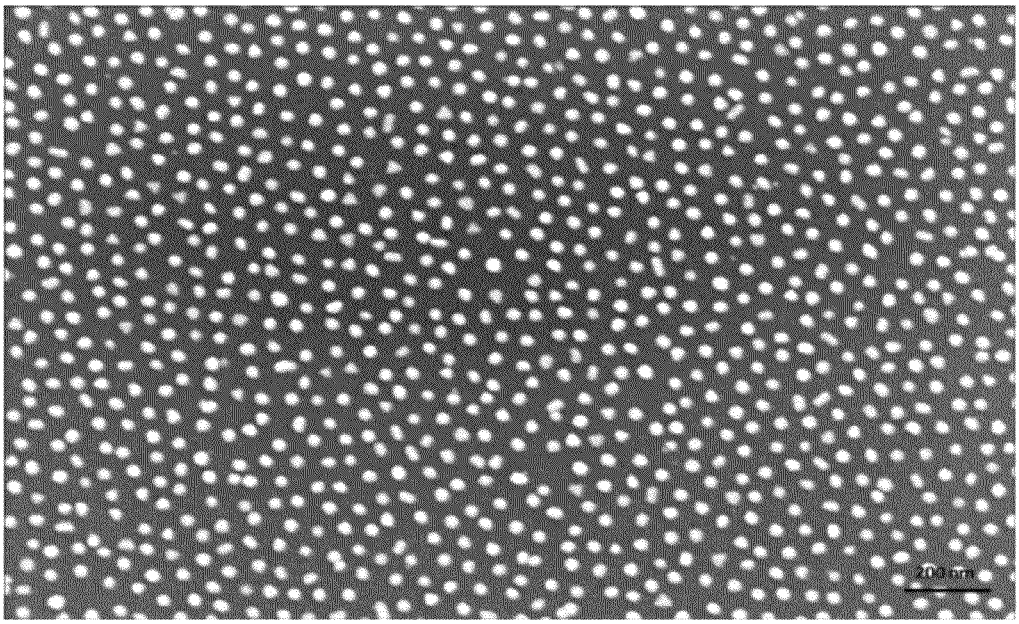
FIG. 5 shows gold nanoparticles after silanization and 3 min of UV irradiation (diameter of the nanoparticles: around 15 nm).

The sample being irradiated, consisting of $SiO_2$, whose surface had gold nanoparticles with a mean diameter of around 9 nm (FIG. 2), was treated with silane (gas phase deposition of 3-aminopropyltriethoxysilane (APS): Sample+ 30 uL APS (in separate dish) in the desiccator for 30 minutes at 0.3 mbar. After this, 1 h at 80° C. in the oven) and placed in a small vessel for the light exposure. In the vessel was placed a 1:1 mixture of 0.25% gold salt solution ($HAuCl_4$) and ethanol. The quantity of the solution was such that the sample was covered by a liquid film around 1 mm in height. After this, UV light was applied without a mask (commercial UV lamp, wavelength: 410 nm). Exposure times of 2' 30" produced particle diameters of around 13 nm (FIG. 4); exposure times of 3', diameters of around 15 nm (FIG. 5).

EXAMPLE 2

Creation of Ring-shaped Fresnel Diffraction Structures

Fresnel diffraction occurs when the following inequality is fulfilled:

$$F = \frac{a^2}{L\lambda} \geq 1$$

(F=the Fresnel number, a=diaphragm radius, L=distance from diaphragm to screen, λ=wavelength)

This condition is fulfilled in all the following experiments, thus, there is always a Fresnel diffraction and not a Fraunhofer diffraction.

The diffraction integral cannot be solved analytically but only numerically after applying the Fresnel approximation. The resulting diffraction pattern reacts extremely sensitively to the slightest changes in the spacing or the diaphragm diameter. Since a realization of constant conditions (completely planar sample, completely planar mask, no "wave formation" in the solution) can only be done with substantial expense, a more simple (qualitative) approach was chosen for the following experimental layouts and pictures.

The sample being exposed to the light was placed in a small vessel. In the vessel was placed a solution of 1.5 ml of 0.25% gold salt solution ($HAuCl_4$) and ethanol. The quantity of the solution was such that the sample was covered by a liquid film around 1 mm in height. As mask, aluminum foil perforated with holes between 0.6 mm and 2 mm was used. This mask was arranged around 1.1 mm above the sample. After this, UV light was applied for an exposure of 10 or 30 minutes.

Figure 6A:
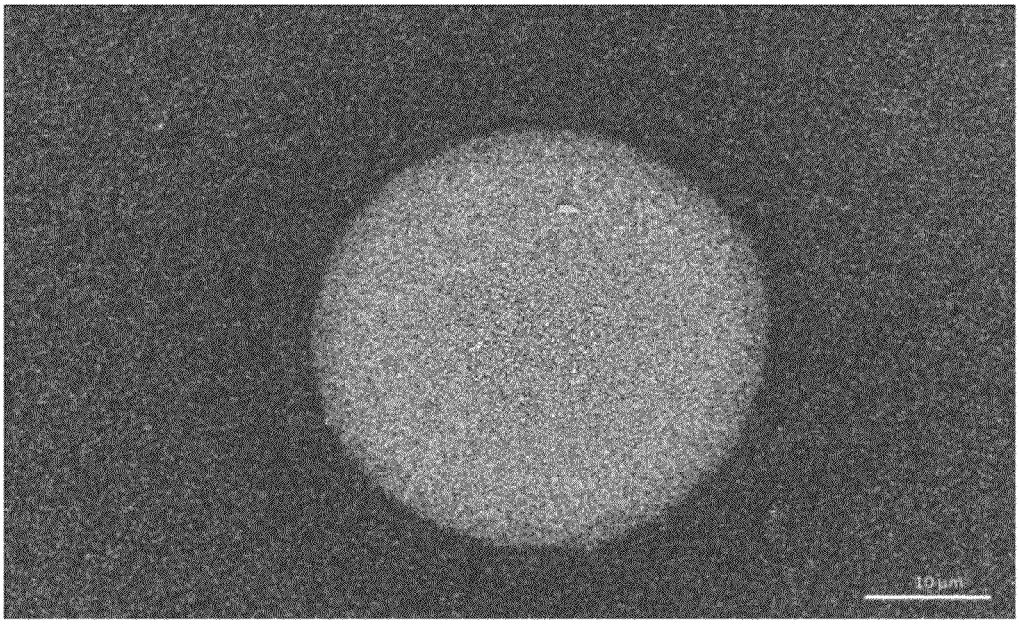
FIG. 6*a*: overall view; 6*b:* enlargement of the bright inner space with strong particle growth; 6*c:* enlargement of the boundary between inner and outer space.
Figure 6B:
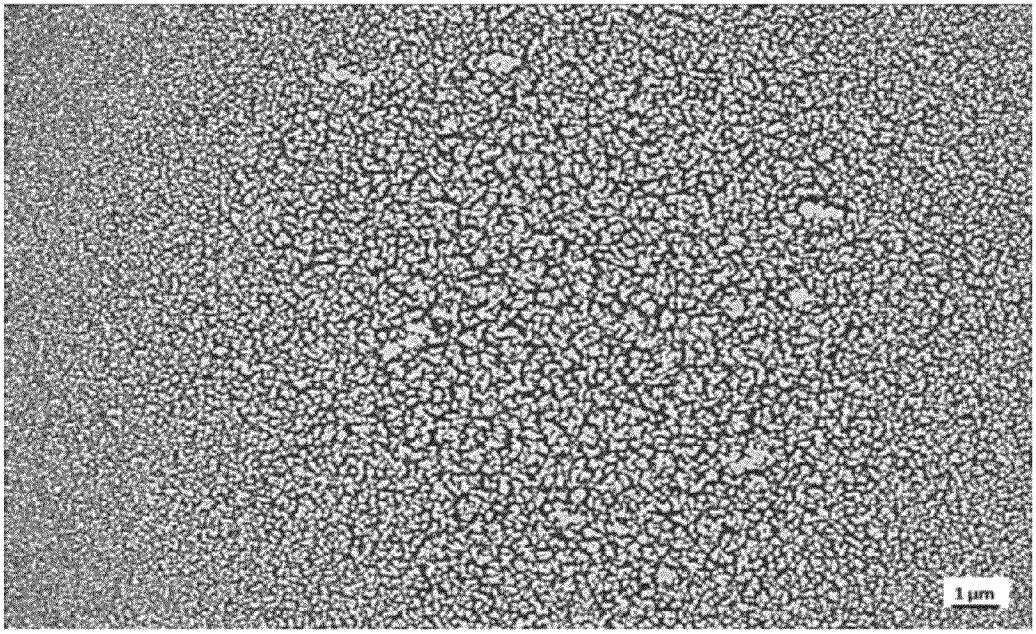
FIG. 6 shows the localized growth of gold nanoparticles at 10 min of UV irradiation making use of a mask with a circular pinhole diaphragm (diameter around 1 mm)
Figure 6C:
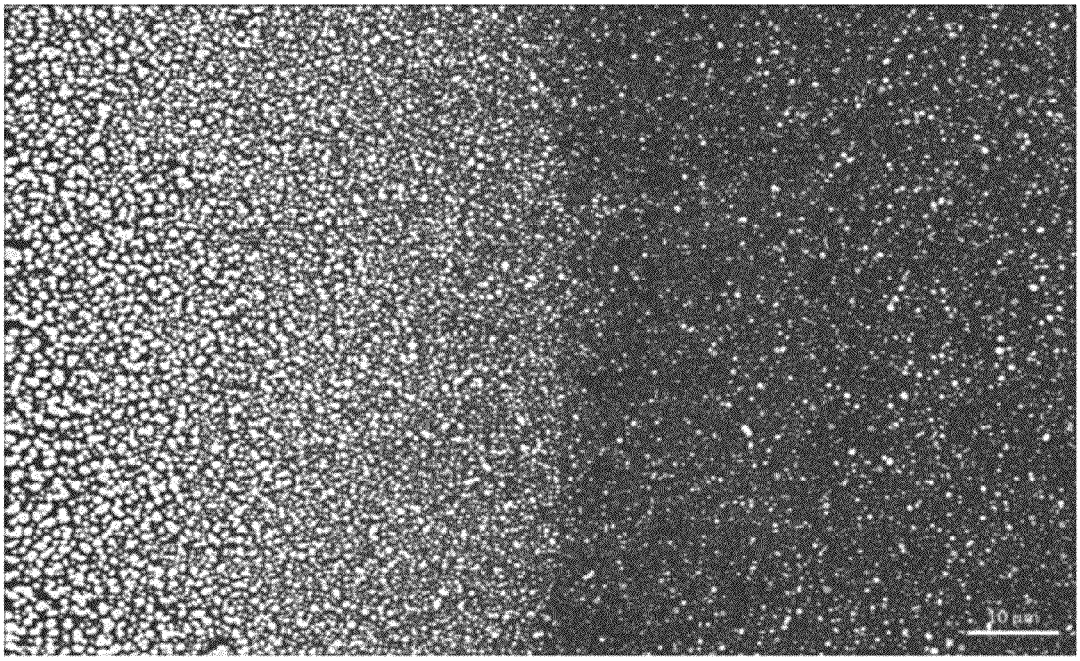

FIG. 6 shows the localized growth of gold nanoparticles at 10 minutes of UV irradiation using a mask with a circular pinhole diaphragm (approximate diameter: 1 mm). One sees here very clearly the brighter inner space, which is clearly delineated from the outer space with less heavily grown particles. But no further diffraction rings are identifiable here (at least, no distinct ones). This might have been due to an unfavorable exposure time for the mask size, for example.

FIG. 9 shows the results when using a slightly elliptical perforated mask and an exposure time of 10 minutes. Diffraction structures are recognizable and these have been photographed with increasing magnification. Once again, the relatively sharp delineation of the individual rings is evident.

FIG. 8 shows the results when using a circular perforated mask and an exposure time of 30 minutes. The longer exposure time leads to a very strong growth at the exposed sites. One sees this in particular in the overall image (very bright ring structure). The region between the dark inner space and the edge toward the strongly enlarged region was magnified. The gold particles in the highest magnification (FIG. 8*d*) form a clearly identifiable edge. A purely qualitative size determination in the SEM leads to a radius of around 10 nm of the smaller (upper half of the picture) and around 17 nm of the larger particles (lower half of the picture).

Figure 7A:
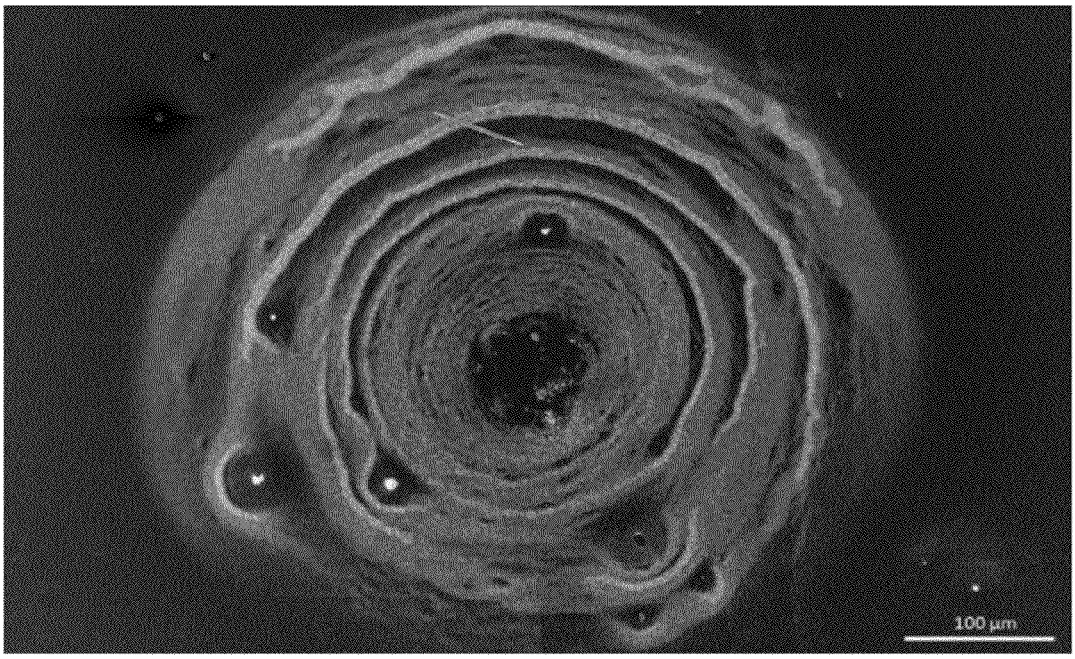
FIG. 7 shows the localized growth of gold nanoparticles at 30 min. UV irradiation making use of a perforated mask with substantially smaller, circular pinhole diaphragm diameter than in FIG. 6: creation of a diffraction pattern with concentric rings; 7*a:* overall view; 7*b:* enlarged ring structure of 7*a*.
Figure 7B:
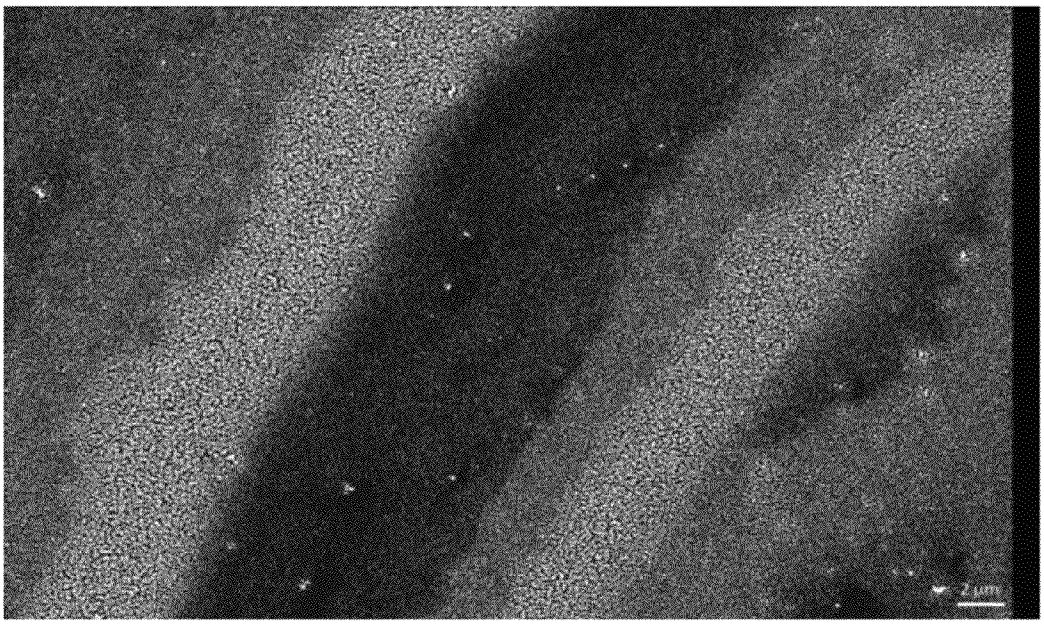
Figure 8A:
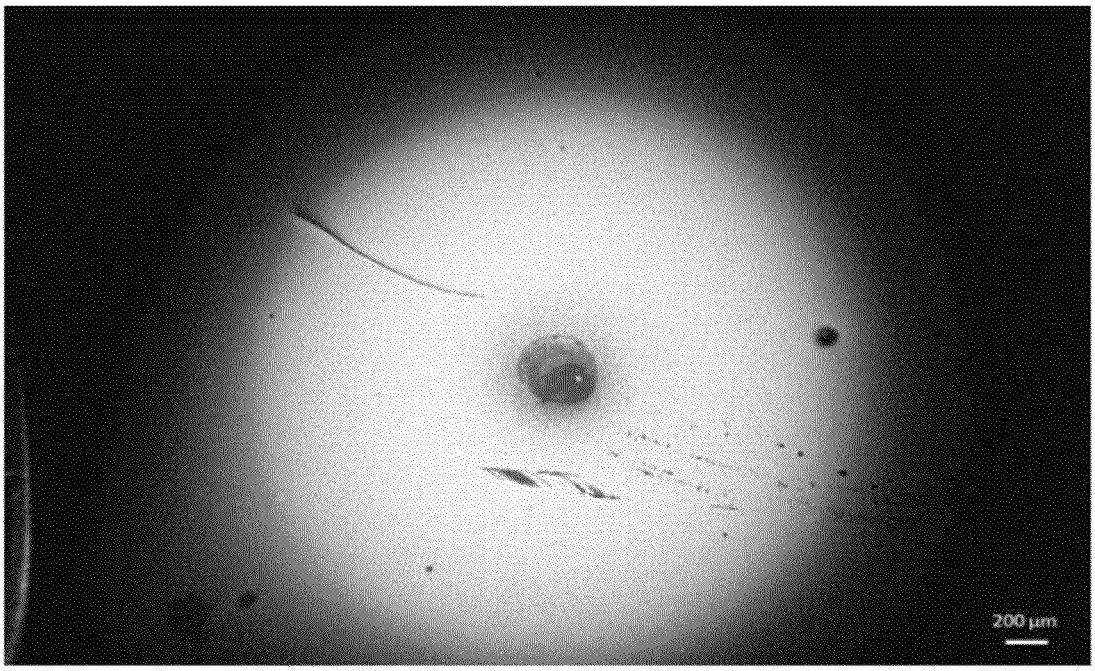
FIG. 8 shows the localized growth of gold nanoparticles at 30 min. of UV irradiation making use of another circular perforated mask; 8*a:* overall view; 8*b-d;* enlargements of the region between the dark inner space and the edge toward the bright inner region with greatly enlarged particles.
Figure 8B:
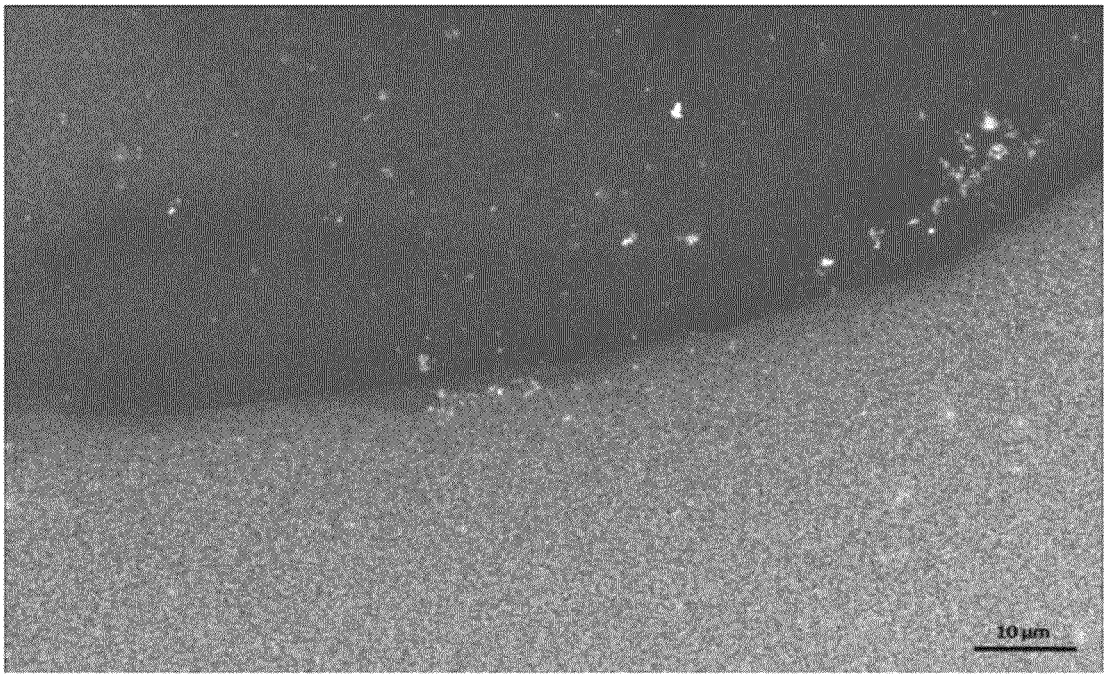
Figure 8C:
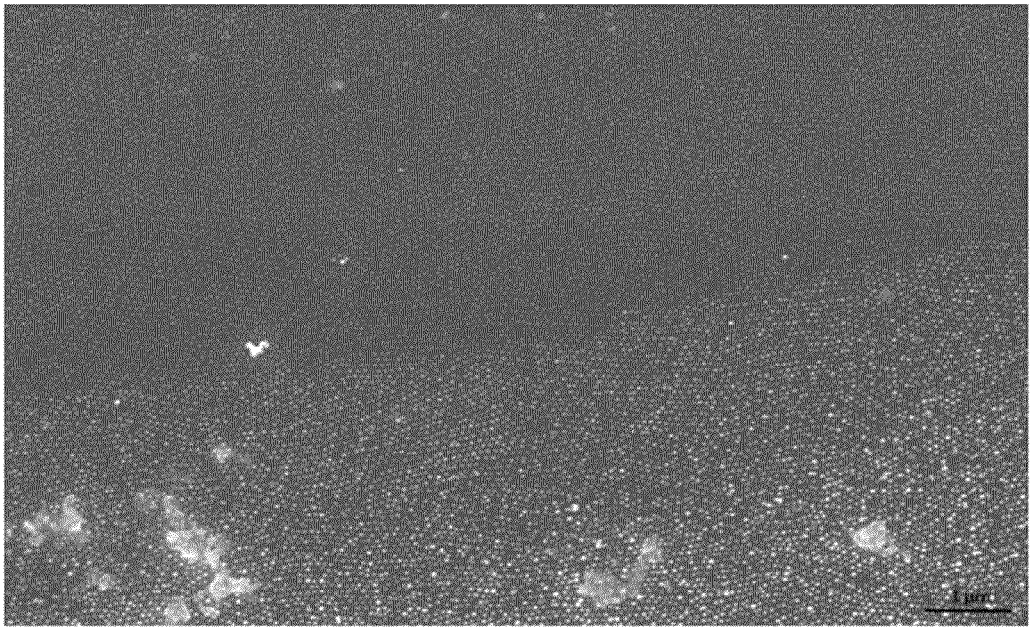
Figure 8D:
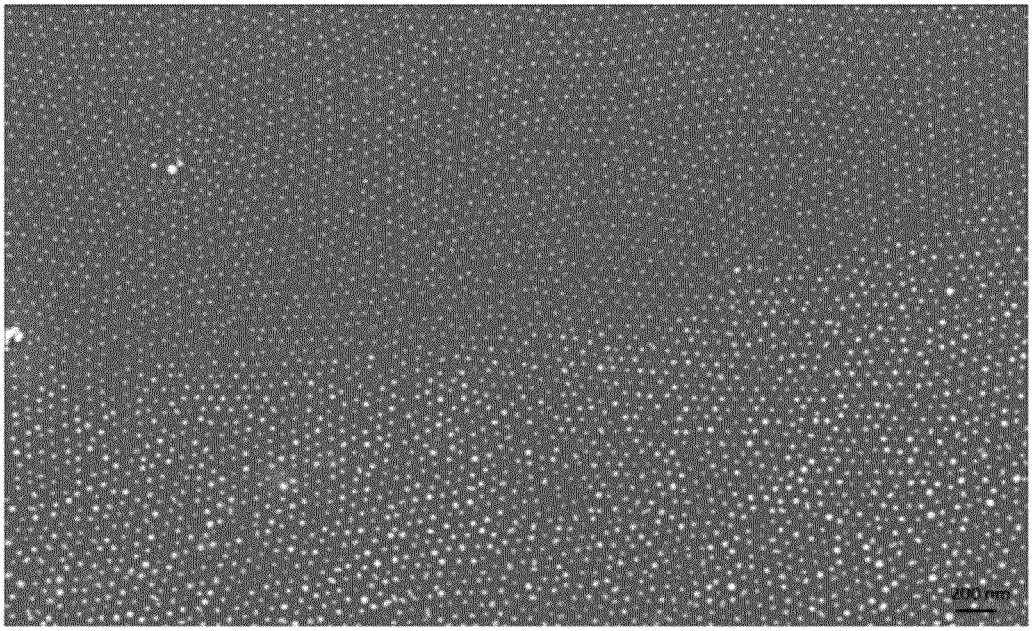
Figure 9A:
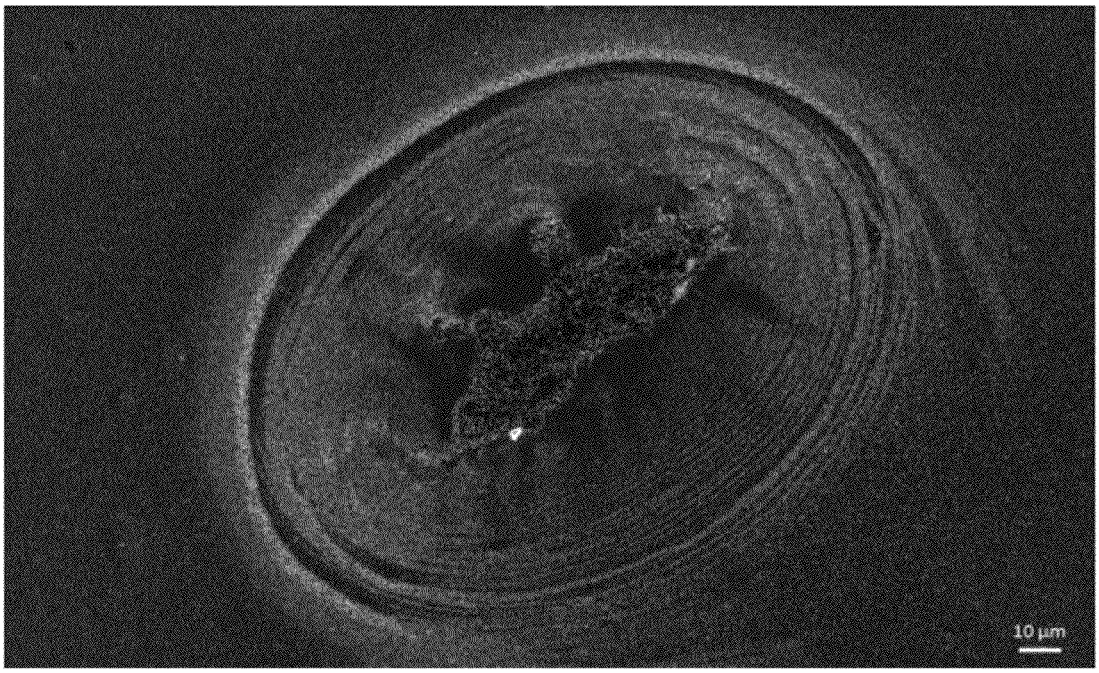
FIG. 9 shows the localized growth of gold nanoparticles with identifiable diffraction structures at 10 min. of UV irradiation making use of a slightly elliptical perforated mask; 9*a:* overall view; 9*b-d:* enlargements of a boundary region.
Figure 9B:
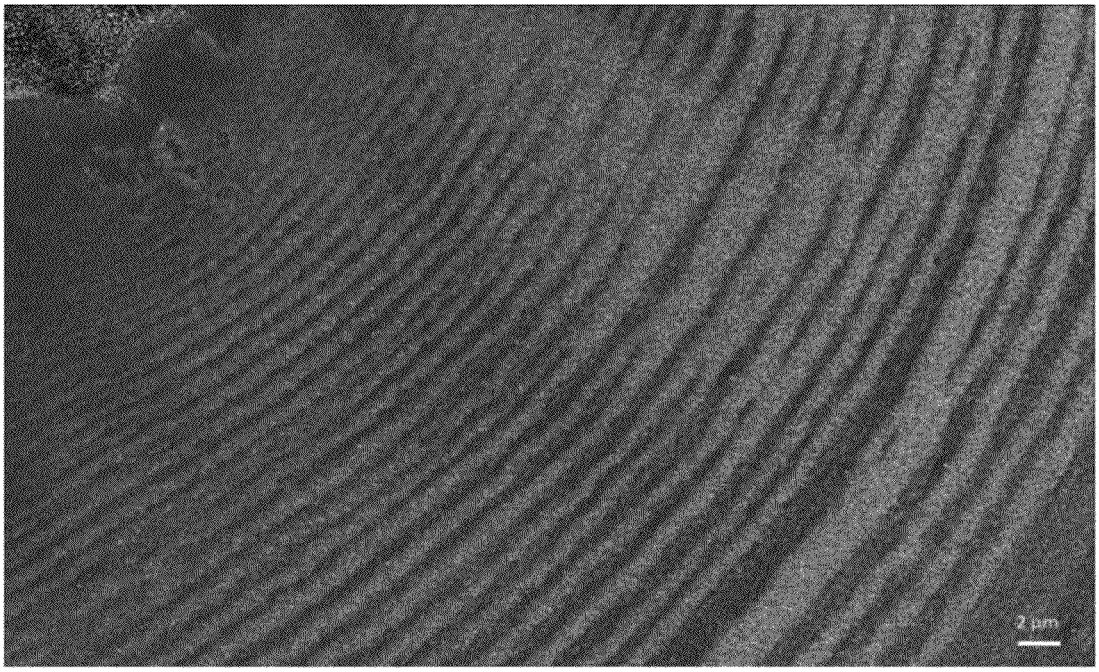
Figure 9C:
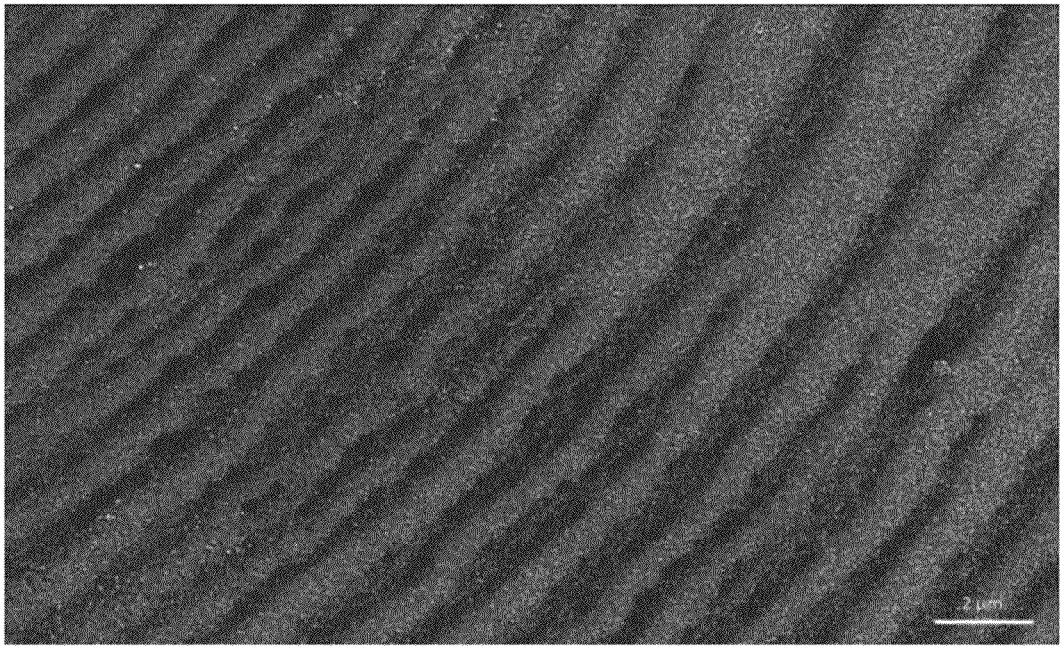
Figure 9D:
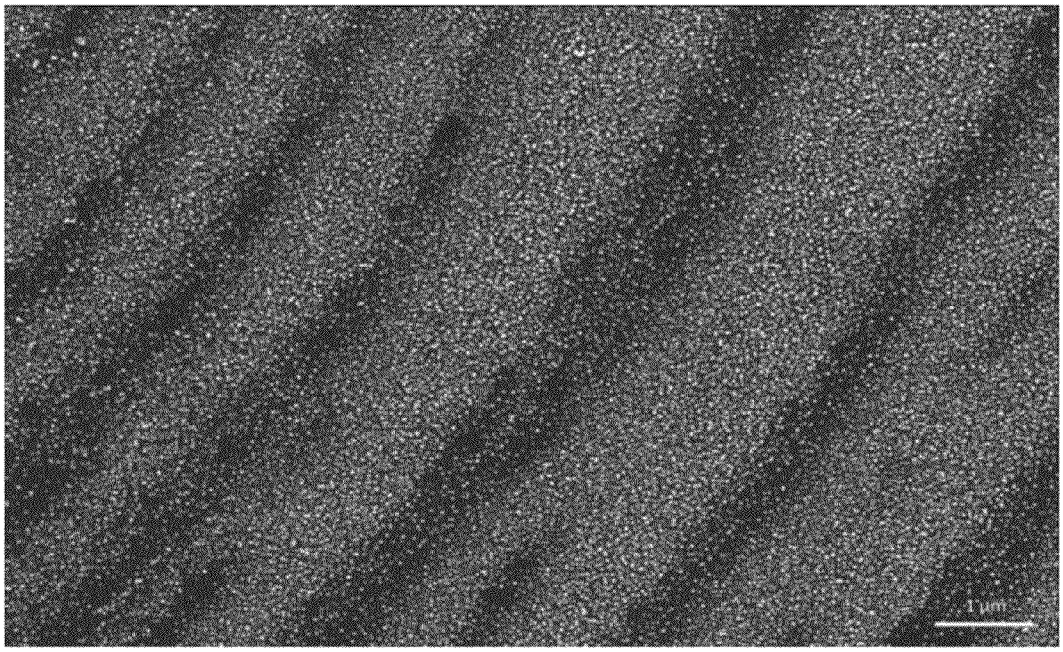

FIG. 7 shows the results when using another circular perforated mask and an exposure time of 30 minutes. Here, diffraction patterns are again recognizable. Also the clearly delineated ring structure is again readily identifiable.

The invention claimed is:

1. Method for spatially resolving an enlargement of precious metal nanoparticles that are present on a substrate, comprising the following steps:

a) providing a substrate coated with the precious metal nanoparticles, b) optionally functionalizing the substrate with an agent that supports adhesion of the precious metal nanoparticles to the substrate, c) contacting the substrate with a precious metal salt solution, d) UV irradiating of the substrate in contact with the precious metal salt solution, thus creating a reduction of the precious metal salt and a currentless deposition of elemental precious metal on the precious metal nanoparticles and corresponding growth of the precious metal nanoparticles in irradiated regions of the substrate, and e) optionally using a mask to bring about a localized growth of the precious metal nanoparticles in predetermined regions of the substrate, wherein the precious metal salt solution is an aqueous metal salt solution to which is added a C1-C10 alcohol which during or after the UV irradiating step forms organic radicals that serve as reducing agents for precious metal ions.

2. Method according to claim 1, wherein the precious metal is a member selected from the group consisting of gold, silver, palladium and platinum.

3. Method according to claim 1, wherein the substrate coated with precious metal nanoparticles is prepared by micellar block copolymer lithography (BCML) or by depositing a precious metal colloidal layer on the substrate surface.

4. Method according to claim 1, wherein the substrate comprises a glass, Si, ZnO, $TiO_2$, GaAs, GaP, GaInP, AlGaAs or $SiO_2$ surface and the functionalizing step b) comprises a silanization.

5. Method according to claim 1, wherein the agent that supports the adhesion of precious metal nanoparticles to the substrate is a silane.

6. Method according to claim 1, characterized in that the C1-C10 alcohol is a member selected from the group consisting of methanol, ethanol, propanol, butanol and ethylene glycol.

7. Method according to claim 1, wherein the precious metal salt solution is a $HAuCl_4$ solution.

8. Method according to claim 1, wherein the UV irradiating is carried out for a time in a range of 1 to 15 minutes and at a wavelength in a range of 200 to 600 nm.

9. Method according to claim 1, wherein conditions of the UV irradiating are varied for at least two different regions of the substrate, so that at least two different regions with different mean diameters of the precious metal nanoparticles are created for the at least two different regions of the substrate.

10. Method according to claim 9, wherein variation of the conditions of UV irradiation constitutes or includes a variation of a time of irradiation.

11. Method according to claim 1, wherein step e) is carried out using a mask that contains at least one pinhole diaphragm with a pinhole diameter of <10 μm, other diffraction lattices, diffraction edges or gradients, and under such conditions that a diffraction pattern or brightness pattern is formed on the substrate surface and the growth of the precious metal nanoparticles occurs selectively in more heavily irradiated regions of the diffraction pattern or brightness pattern.

12. Method according to claim 11, wherein step e) is carried out using a mask that contains at least one pinhole diaphragm with a pinhole diameter of <10 μm of circular, elliptical, rectangular or triangular form.

13. Method according to claim 12, wherein the at least one pinhole diaphragm has a circular diameter, so that when irradiated a diffraction pattern of concentric rings is formed on the substrate surface and the different regions created with different mean diameters of the precious metal nanoparticles likewise form a pattern of concentric rings.

14. Method for making a nanostructured substrate surface, comprising:

a) providing a substrate coated with precious metal nanoparticles, b) optionally functionalizing the substrate with an agent that supports adhesion of the precious metal nanoparticles to the substrate, c) contacting the substrate with a precious metal salt solution, d) UV irradiating of the substrate in contact with the precious metal salt solution, thus creating a reduction of the precious metal salt and a currentless deposition of elemental precious metal on the precious metal nanoparticles and corresponding growth of the precious metal nanoparticles in irradiated regions of the substrate, e) optionally using a mask to bring about a localized growth of the precious metal nanoparticles in predetermined regions of the substrate, and f) subjecting the substrate resulting from step (d) or optional step (e) to at least one etching step, in which the precious metal nanoparticles act as an etching mask, whereby selective etching in predetermined regions of the substrate creates a desired relief configuration of the substrate surface while retaining a pattern of the precious metal nanoparticle arrangement, wherein the precious metal salt solution is an aqueous metal salt solution to which is added a C1-C10 alcohol which during or after the UV irradiating step forms organic radicals that serve as reducing agents for precious metal ions.

15. Method for making a nanostructured substrate surface according to claim 14, wherein:

step e) is carried out using a mask that contains at least one pinhole diaphragm with a pinhole diameter of <10 μm and a circular diameter, so that when irradiated a diffraction pattern of concentric rings is formed on the substrate surface and the different regions created with different mean diameters of the precious metal nanoparticles likewise form a pattern of concentric rings; and in step (f), selective etching in predetermined regions of the substrate creates a relief configuration of the substrate surface that corresponds to a Fresnel lens, while retaining the pattern of concentric rings.

16. Method of claim 1, wherein the agent that supports the adhesion of precious metal nanoparticles to the substrate is a member selected from the group consisting of 3-aminopropyltriethoxysilane (APS), 3-mercaptopropyltriethoxysilane (MPS), N-[3-(tri-methoxysilyl)propyl)ethylene diamine, 3-[2-(2-aminoethylamino)-ethylamino]propyltrimethoxysilane, 3-aminopropyldimethyl-methoxysilane, 3-aminopropyl)tris(trimethylsiloxy)silane and 3-mercaptopropyltrimethoxysilane.

* * * * *